US011427994B2

(12) United States Patent
Jensen

(10) Patent No.: US 11,427,994 B2
(45) Date of Patent: Aug. 30, 2022

(54) PRESSURIZED TOILET

(71) Applicant: AS America, Inc., Piscataway, NJ (US)

(72) Inventor: Robert Jensen, East Brunswick, NJ (US)

(73) Assignee: AS America, Inc., Piscataway, NJ (US)

( * ) Notice: Subject to any disclaimer, the term of this patent is extended or adjusted under 35 U.S.C. 154(b) by 0 days.

(21) Appl. No.: 17/277,232

(22) PCT Filed: Sep. 27, 2019

(86) PCT No.: PCT/US2019/053347
§ 371 (c)(1),
(2) Date: Mar. 17, 2021

(87) PCT Pub. No.: WO2020/069249
PCT Pub. Date: Apr. 2, 2020

(65) Prior Publication Data

US 2021/0355667 A1 Nov. 18, 2021

Related U.S. Application Data

(60) Provisional application No. 62/738,719, filed on Sep. 28, 2018.

(51) Int. Cl.
*E03D 1/08* (2006.01)
*E03D 1/22* (2006.01)

(52) U.S. Cl.
CPC ..... *E03D 1/082* (2013.01); *E03D 1/22* (2013.01)

(58) Field of Classification Search
CPC ..... E03D 1/082
USPC ..... 4/332, 329, 354, 300, 335, 336, 334
See application file for complete search history.

(56) References Cited

U.S. PATENT DOCUMENTS

| | | | | |
|---|---|---|---|---|
| 8,281,424 | B2 * | 10/2012 | Okubo | E03D 5/01 4/431 |
| 10,941,550 | B2 | 3/2021 | Pancurak et al. | |
| 2010/0077544 | A1 | 4/2010 | Okubo et al. | |
| 2012/0240322 | A1 | 9/2012 | Wang et al. | |
| 2015/0345124 | A1 | 12/2015 | Li | |
| 2017/0370080 | A1 | 12/2017 | Kashirajima et al. | |
| 2017/0370081 | A1 | 12/2017 | Kashiramima et al. | |
| 2018/0363281 | A1 | 12/2018 | Pancurak et al. | |
| 2019/0063053 | A1 | 2/2019 | Chen et al. | |
| 2019/0330831 | A1 | 10/2019 | Pancurak | |

FOREIGN PATENT DOCUMENTS

CN 204919733 U 12/2015

OTHER PUBLICATIONS

International Search Report dated Dec. 3, 2019 in corresponding International Application No. PCT/US2019/053347 (2 pages).

* cited by examiner

*Primary Examiner* — Lori L Baker
(74) *Attorney, Agent, or Firm* — Tyler A. Stevenson; Anna-lisa L. Gallo

(57) ABSTRACT

A pressurized tank assembly and method. The pressurized tank assembly may include a first siphon tank, a second siphon tank, an inlet assembly, and a discharge assembly. The first tank and second tank may be arranged vertically within the base of the toilet. The first tank and the second tank may be arranged with endcaps located at the top of each tank. The first tank and the second tank may include siphon tubes to assist in delivering fluid flow from the inlet assembly to the discharge assembly.

21 Claims, 12 Drawing Sheets

PRESSURIZED TOILET

The disclosure relates to a pressurized toilet and method of operating a pressurized toilet. In some embodiments, the disclosure relates to a pressurized toilet having a siphon tube and a method of creating a siphon to perform a pressurized flush.

BACKGROUND

Pressure-assisted (pressure-assist) toilets may comprise a pressure tank. Water fills the pressure tank and is held under pressure. When a flush valve opens, pressure and gravity combine for a flush. Pressure-assist toilets, sometimes referred to as power flush toilets, use less water and can flush with more force than a standard gravity powered toilet. Pressure-assist toilets typically include both a water tank and a pressure tank. The pressure tank may be located inside a toilet tank. Pressure-assist toilets use water main pressure to pressurize the pressure tank.

Pressure-assist toilets have a larger construction to accommodate all of the features of the pressurized system. A need exists for a small footprint, low profile toilet having a pressure-assisted flush, where the flush delivers a sufficient flush rate and volume to evacuate the bowl of the toilet. There is a need for a tankless pressurized toilet.

SUMMARY

Accordingly, disclosed is a pressure-assist toilet assembly comprising a toilet base comprising a toilet bowl and a chamber; and a pressurized tank assembly positioned in the chamber, wherein the pressurized tank assembly comprises a siphon assembly, and the siphon assembly comprises a siphon tube positioned within a siphon tank.

Also disclosed is a pressurized tank assembly for a toilet, comprising a siphon assembly comprising a first siphon tank having a first tank body and a first tank endcap; a second siphon tank having a second tank body and a second tank endcap; and a first siphon tube positioned within the first tank body and a second siphon tube positioned within the second tank body; and an inlet assembly fluidly coupled to the first siphon tank, and a discharge assembly fluidly coupled to the second siphon tank.

Also disclosed is a method for flushing a toilet, the method comprising charging a pressurized tank assembly, the pressurized tank assembly having a siphon assembly; and discharging a predetermined flush volume from the pressurized tank assembly to a toilet bowl.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1A:
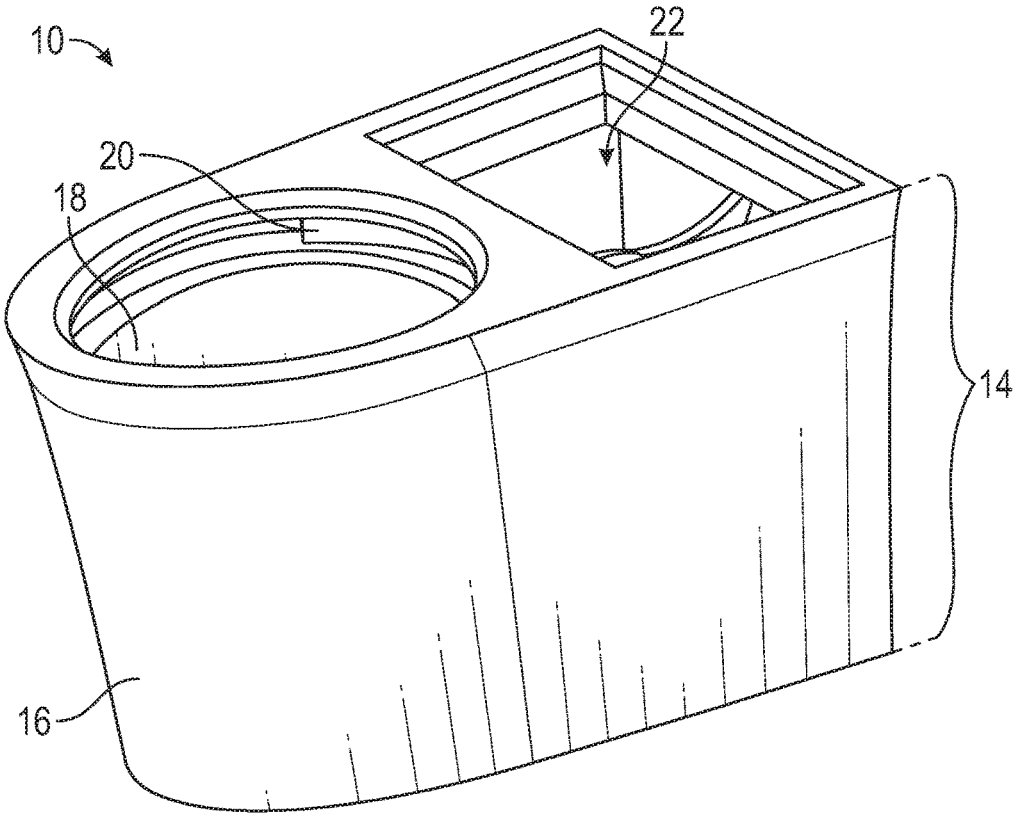
FIG. 1A and FIG. 1B show a perspective view of a toilet configured to receive a pressurized tank assembly and a pressurized toilet, according to an embodiment.

In some embodiments, the disclosure relates to a pressure-assist toilet having a pressurized tank assembly. The pressurized tank assembly can be housed in a base of the toilet. Despite the typical bulk of a pressurized toilet system, the pressurized tank assembly, in accordance with the principles of the invention, achieves a smaller footprint and lower profile toilet, while also allowing for repair and replacement access to the pressurized tank assembly. The pressurized tank assembly, in accordance with the principles of the invention, also allows for delivery of the desired flush rate and volume to effectively evacuate the bowl of the toilet. The pressurized tank assembly may include a pair of vertically oriented tanks and flow passes from an inlet assembly through a first siphon tank, then a second siphon tank, to a discharge assembly. In some embodiments, siphon tubes are provided in the tanks for delivering fluid flow along the flow path from inlet to discharge. The tanks may be arranged with endcaps having an inlet assembly and discharge assembly located towards the top of each tank. Placing the tanks in the toilet base vertically and with the inlet and discharge functionality at the top may allow for ease of installation, improved serviceability, and a reduction in the footprint of the chinaware (e.g. the base of the toilet).

In some embodiments, tank endcaps may be arranged to be facing upward when positioned in a toilet base chamber.

According to an embodiment, a pressure-assist toilet may include a toilet base having a toilet bowl and a chamber; and a pressurized tank assembly located within the chamber, wherein the pressurized tank assembly includes a siphon assembly, wherein the pressurized tank assembly is configured to provide a fluid flow to the toilet bowl, and wherein the fluid flow is assisted by a fluid siphon effect created by the siphon assembly.

In an embodiment, a siphon assembly is configured to provide a fluid siphon effect, wherein the siphon effect encourages a fluid flow to the toilet bowl. The phrase "encourages a fluid flow to the toilet bowl" may mean "is at least partially responsible for" or "aids" or "assists" a fluid flow. A "fluid flow" to a toilet bowl may mean configured for a toilet flush.

According to an embodiment, a pressurized tank assembly may include a first siphon tank having a first siphon tube. The first siphon tube may be located substantially concentrically within a first tank body of the first tank. The first siphon tube may be coupled to a first endcap of the first tank, the first siphon tube configured to admit fluid from an inlet assembly.

According to an embodiment, a pressurized tank assembly may include a second siphon tank having a second siphon tube.

According to an embodiment, a pressurized tank assembly may be configured to allow fluid to flow through an inlet of a first tank, through a first siphon tube, through a space between the first siphon tube and a first tank body, through a space between a second siphon tube and a second tank body, through the second siphon tube to exit an outlet of the second tank.

According to an embodiment, a pressurized tank assembly may be configured to allow fluid to flow through an inlet of a first tank, through a space between a first siphon tube and a first tank body, through the first siphon tube, through a space between a second siphon tube and a second tank body, through the second siphon tube to exit an outlet of the second tank.

According to an embodiment, a pressurized tank assembly may include a first tank and a second tank, wherein a first endcap of the first tank and a second endcap of the second tank are located near or towards an upper surface of a toilet base.

According to an embodiment, a pressurized tank assembly may include a first tank, a second tank, an inlet assembly, and a discharge assembly. The first tank further may include a first tank body, a first tank endcap, and a first siphon tube and a second tank may include a second tank body, a second tank endcap, and a second siphon tube, wherein the first tank endcap and the second tank endcap are arranged near or towards an upper surface of a toilet base. A lid may cover the first tank endcap and second tank endcap, the lid configured to rest on the toilet base.

According to an embodiment, a siphon assembly may include a first siphon tube positioned in a first tank and a second siphon tube positioned in a second tank.

According to an embodiment, a pressurized tank assembly may include a first tank and a second tank, wherein the first tank and the second tank are located on opposing sides of a trapway within a toilet base chamber. According to an embodiment, a toilet base may include a first recess configured to receive a first tank and a second recess configured to receive a second tank.

According to an embodiment, a pressurized tank assembly for a toilet may include a first tank having a first tank body and a first tank endcap; a second tank having a second tank body and a second tank endcap; a first siphon tube positioned within the first tank body and a second siphon tube positioned within the second tank body.

According to an embodiment, a pressurized tank assembly may include an inlet assembly and a discharge assembly. The inlet assembly may include a pressure regulator, a venturi, an aspirator, and a check valve, the inlet assembly located upstream of the first tank. The discharge assembly may include a discharge valve, a jet discharge port, and a rim discharge port, the discharge assembly located downstream of the second tank.

According to an embodiment, a first tank and a second tank are arranged in series and are in flow communication.

According to an embodiment, a bridge may couple a first tank to a second tank, the bridge configured to facilitate removal of the pressurized tank assembly from a toilet chamber.

In some embodiments, a bridge may provide a manner in which to remove a pressurized tank assembly from a toilet assembly. A bridge elongated portion may operate as a handle and allow for a user to grasp with one or both hands. A pressurized tank assembly may be removed to allow for maintenance of the pressurized tank assembly, or of components, connections, or couplings thereof, and/or of the toilet assembly. In some embodiments, a bridge may comprise an elongated portion and rounded end portions. In some embodiments, rounded ends may have a similar shape to a cross-section of endcaps.

In some embodiments, a bridge may couple a first tank to a second tank. A bridge may be a structural connection that secures a first tank endcap to a second tank endcap. A bridge may not provide for fluid flow, a fluid flow connection between a first siphon tank and a second siphon tank may be via a conduit. In some embodiments, a bridge may be substantially flat and/or structurally rigid and provide a connection between a first siphon tank and a second siphon tank and may operate as a handle for lifting a pressurized tank assembly into and out of a chamber of a toilet assembly. In some embodiments, a bridge is positioned near or towards an upper surface of a toilet base.

According to an embodiment, a first siphon tube may have a first length, the first length configured to allow a predetermined flush volume to be discharged from the pressurized tank assembly. In some embodiments, a desired flush volume is about 1.28 gallons per flush (gpf). In some embodiments, a desired flush volume is about 1.6 gpf.

According to an embodiment, a method for flushing a toilet may include charging a pressurized tank assembly, the pressurized tank assembly having a siphon assembly; and discharging a predetermined flush volume from the pressurized tank assembly to a toilet bowl. According to an embodiment, charging the pressurized tank assembly may include admitting a fluid from an inlet assembly to a first tank having a first siphon tube and allowing fluid flow from the first tank to a second tank having a second siphon tube.

According to some methods, a fluid flow entering the inlet assembly comprises a mixture of air and water. In some embodiments, air is admitted to the fluid flow through an aspirator and water is admitted to the fluid flow through a water supply inlet coupling.

In some embodiments, fluid flows through an inlet of the first tank, through the first siphon tube, through a space between the first siphon tube and a first tank body, through a space between the second siphon tube and a second tank body, through the second siphon tube to exit an outlet of the second tank. In some embodiments, fluid flows through an inlet of the first tank, through a space between the first siphon tube and a first tank body, through the first siphon tube, through a space between the second siphon tube and a second tank body, through the second siphon tube to exit an outlet of the second tank.

In some embodiments, a toilet assembly comprises no toilet water tank.

In some methods, the pressurized tank assembly comprises a first tank and a second tank, and wherein discharging the predetermined flush volume in the toilet bowl comprises discharging a fluid from the second tank through a discharge valve and then through a jet discharge port and a rim discharge port.

In some methods, a predetermined flush volume may be based on a length of at least one of the first siphon tube and the second siphon tube.

In some method embodiments, discharging a predetermined flush volume from the pressurized tank assembly to the toilet bowl includes creating a siphon effect within the siphon assembly to assist in flow of a predetermined flush volume from the pressurized tank assembly to the toilet bowl.

According to an embodiment, fluid flow entering an inlet assembly may include an air/water mixture. According to an embodiment, air may be admitted to the fluid flow through an aspirator and water may be admitted to the fluid flow through a water supply inlet coupling.

According to an embodiment, fluid may flow through an inlet of a first tank, through a first siphon tube, through a space between the first siphon tube and a first tank body, through a space between the second siphon tube and a second tank body, and through the second siphon tube to exit an outlet of the second tank.

According to an embodiment, fluid may flow through an inlet of the first tank, through a space between a first siphon tube and a first tank body, through the first siphon tube, through a space between the second siphon tube and a second tank body, and through the second siphon tube to exit an outlet of the second tank.

According to an embodiment, a pressurized tank assembly may include a first tank and a second tank, and wherein discharging a predetermined flush volume in the toilet bowl may include discharging a fluid from the second tank through a discharge valve and then through a jet discharge port and a rim discharge port.

According to an embodiment, a siphon assembly may include a first tank having a first siphon tube and a second tank having a second siphon tube.

According to an embodiment, a predetermined flush volume may be based on a length of at least one of the first siphon tube and the second siphon tube.

According to an embodiment, discharging a predetermined flush volume from a pressurized tank assembly to a toilet bowl may include creating a siphon effect within a siphon assembly to assist in flow of the predetermined flush volume from the pressurized tank assembly to the toilet bowl.

Figure 1B:
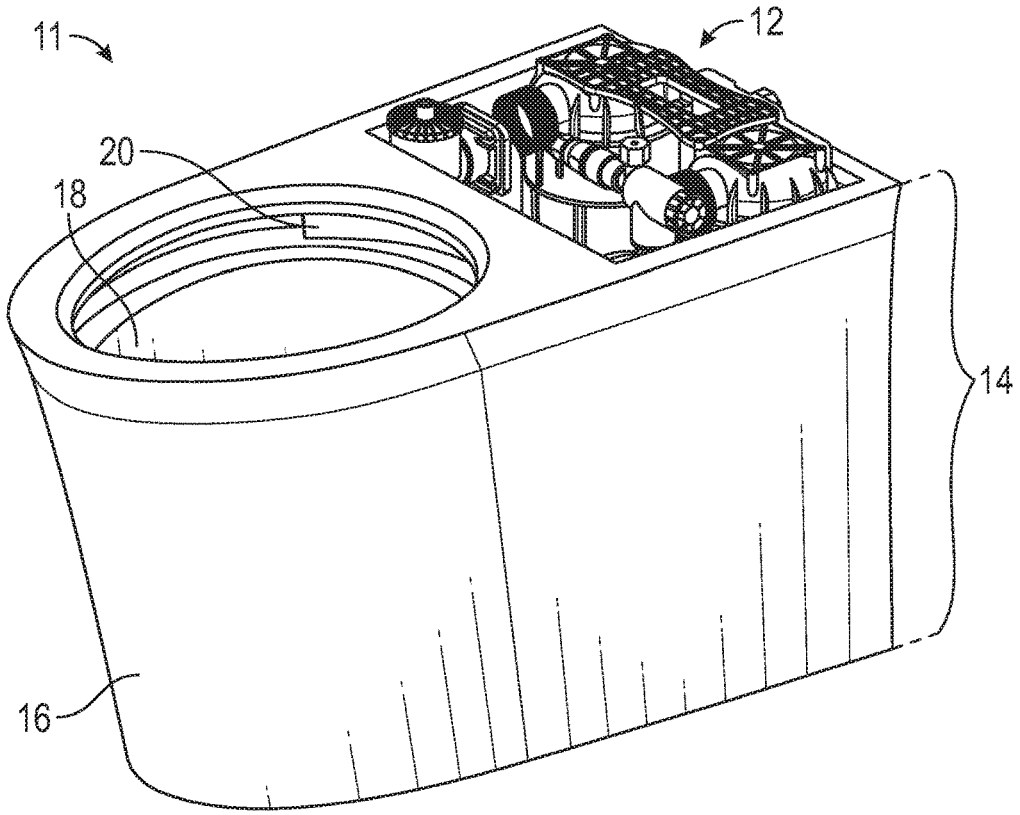

FIG. 1A shows a toilet 10 comprising chamber 22 configured to receive a pressurized tank assembly 12. FIG. 1B shows pressure-assist toilet assembly 11 having a pressurized tank assembly 12 disposed therein. Toilets 10 and 11 include a base 14 having a sidewall 16 which conceals a trapway (not visible). Toilets 10 and 11 include a bowl 18 having a rim channel 20. Base 14 has a top upper edge and a bottom lower edge.

Figure 2:
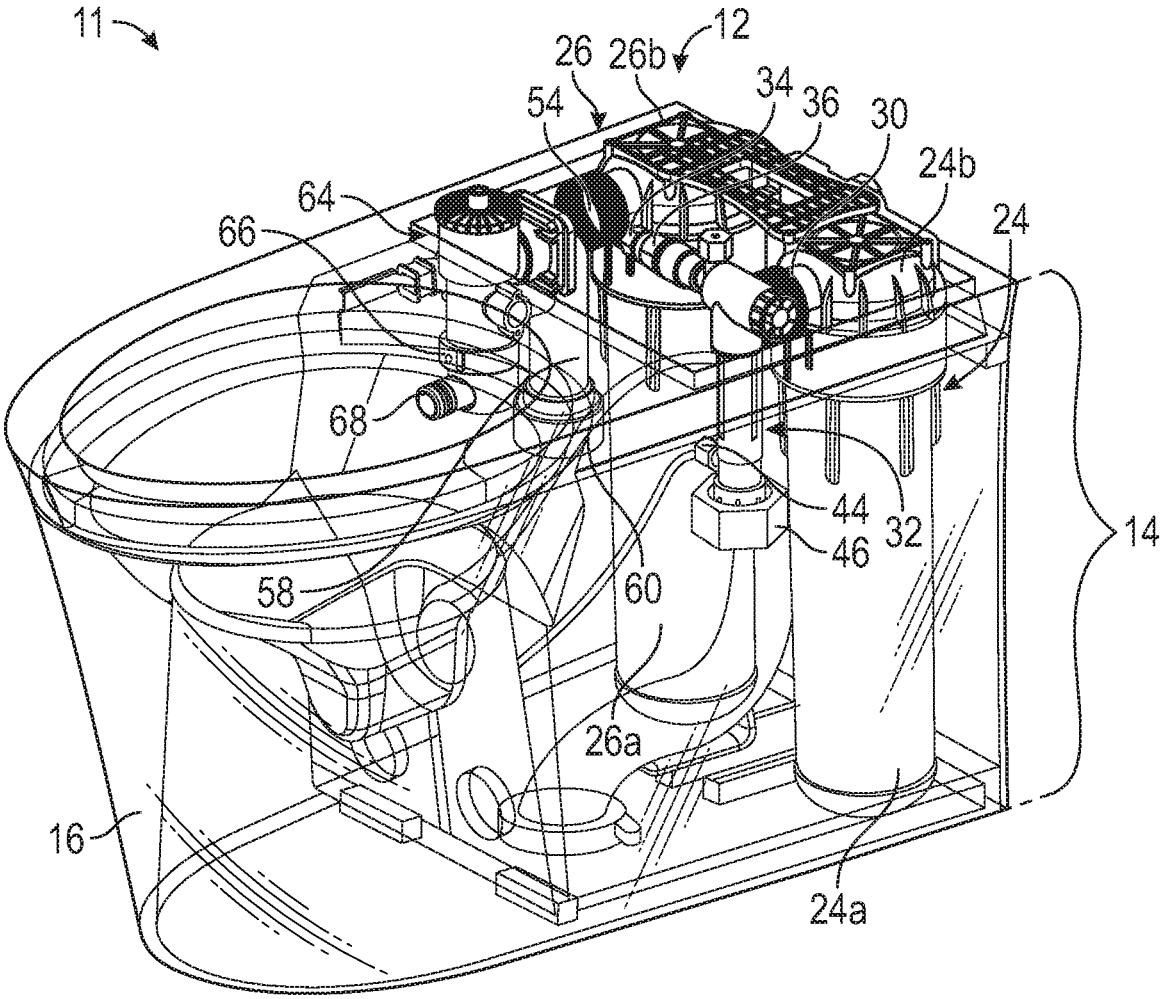
FIG. 2 shows a "see-through" perspective view of the pressurized toilet.

FIG. 2 shows toilet assembly 11 with a transparent sidewall 16 of base 14 such that internal components are visible. Pressurized tank assembly 12 includes a first siphon tank 24 and a second siphon tank 26. First tank 24 may be a main tank, that is, a tank which supplies fluid to second tank 26. Second tank 26 may be a discharge tank, that is, a tank which supplies fluid to toilet assembly 11. First tank 24 may be arranged in series with second tank 26. That is, flow from first tank 24 may flow directly into second tank 26. First tank 24 comprises a first tank body 24*a* and a first tank endcap 24*b* secured thereto. First tank endcap 24*b* comprises a dome shape. First tank endcap 24*b* is fluidly coupled to an interior of the first tank body 24*a*. Second tank 26 comprises second tank body 26*a* and second tank endcap 26*b*. First tank 24 comprises a first tank inlet 30 coupled to inlet assembly 32. Inlet assembly 32 includes a water supply inlet coupling 34. Water supply inlet coupling 34 may be coupled to a water supply line, main water source, and/or water supply from a wall of a restroom. Inlet assembly 32 includes a regulator 36. Regulator 36 is coupled to water supply inlet coupling 34. Regulator 36 may control the pressure of water flowing into first tank 24 from a water supply. Aspirator 44 may admit air into the water flow from water supply inlet coupling 34 to provide a mixed flow of water and air to first tank 24. Inlet assembly 32 includes coupling 46. Coupling 46 may couple a conduit, such as a tube (not depicted), between the inlet assembly 32 and the first tank inlet 30. Endcaps 24*b* and 26*b* are facing upward within the toilet base chamber.

Second tank 26 comprises second tank body 26*a* and second tank endcap 26*b*. Second tank body 26*a* may be a substantially cylindrical housing. Second tank endcap 26*b* comprises a dome shape. Second tank 26 includes a second tank outlet 54 coupled to discharge assembly 64. Discharge assembly 64 includes a riser tube 58 connected with coupling 60 to second tank outlet 54. Discharge valve assembly 64 is coupled to a discharge connection 66. Discharge valve assembly 64 may be a pressure actuated valve. Discharge connection 66 has a jet discharge port 68 and a rim discharge port 70. Jet discharge port 68 may deliver fluid to a jet of toilet assembly 11 and rim discharge port 70 may deliver fluid to a rim channel of toilet assembly 11.

Figure 3:
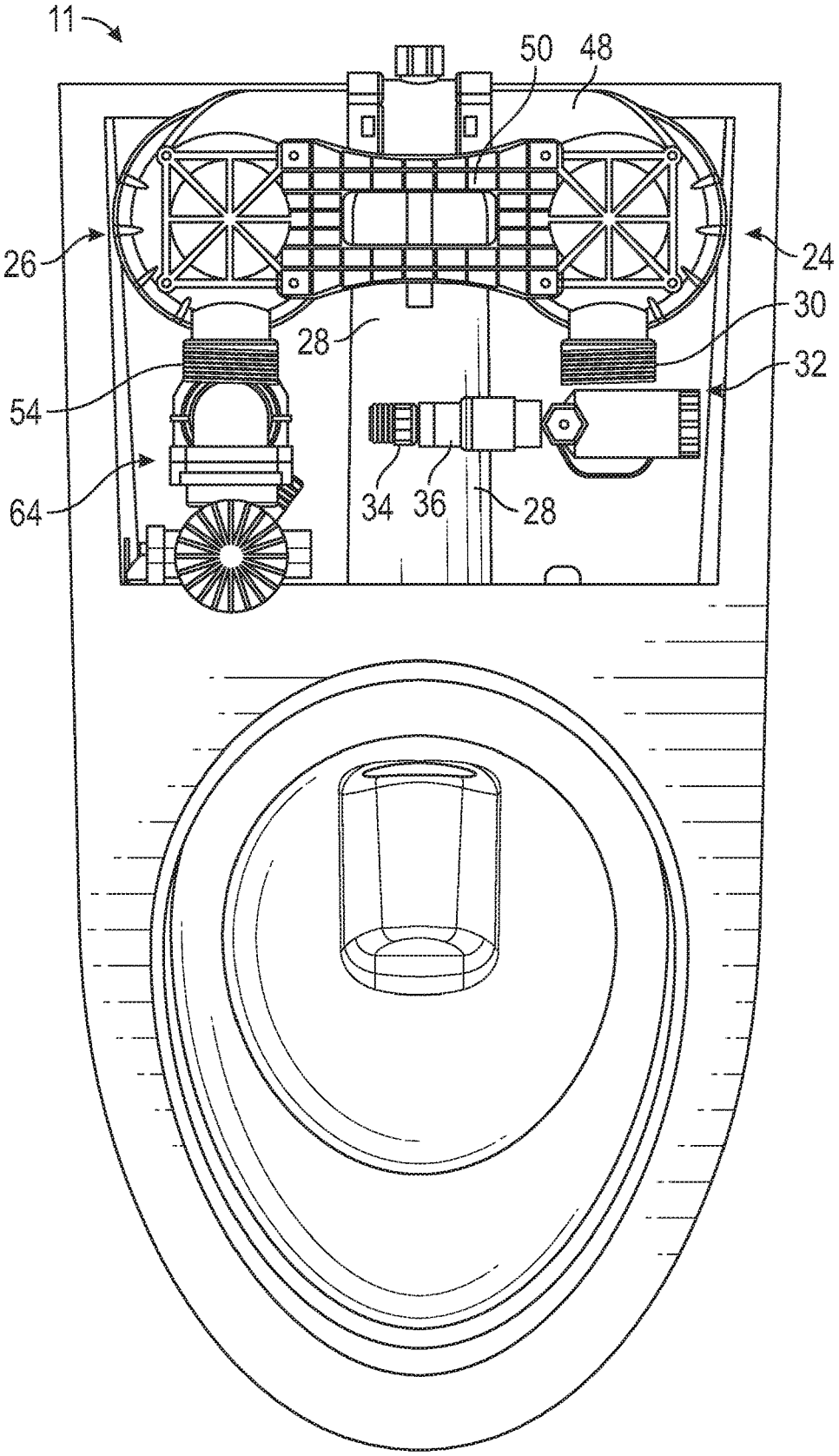
FIG. 3 shows a top view of the pressurized toilet.

FIG. 3 shows first tank 24 coupled to second tank 26. First tank 24 is fluidly coupled to second tank 26 via a conduit 48. Conduit 48 may be a pipe or tube. Conduit 48 may couple a first tank outlet to a second tank inlet. First tank 24 is structurally coupled to second tank 26 via bridge 50. Bridge 50 may be secured to first tank endcap 24*b* and a second tank endcap 26*b*. First tank 24 and second tank 26 are located within chamber 22 of toilet assembly 11. Trapway 28 is also located within chamber 22. First tank 24 is positioned on a first side (e.g. the left side) of trapway 28 and second tank 26 is located on a second side (e.g. the right side) of trapway 28.

Figure 4:
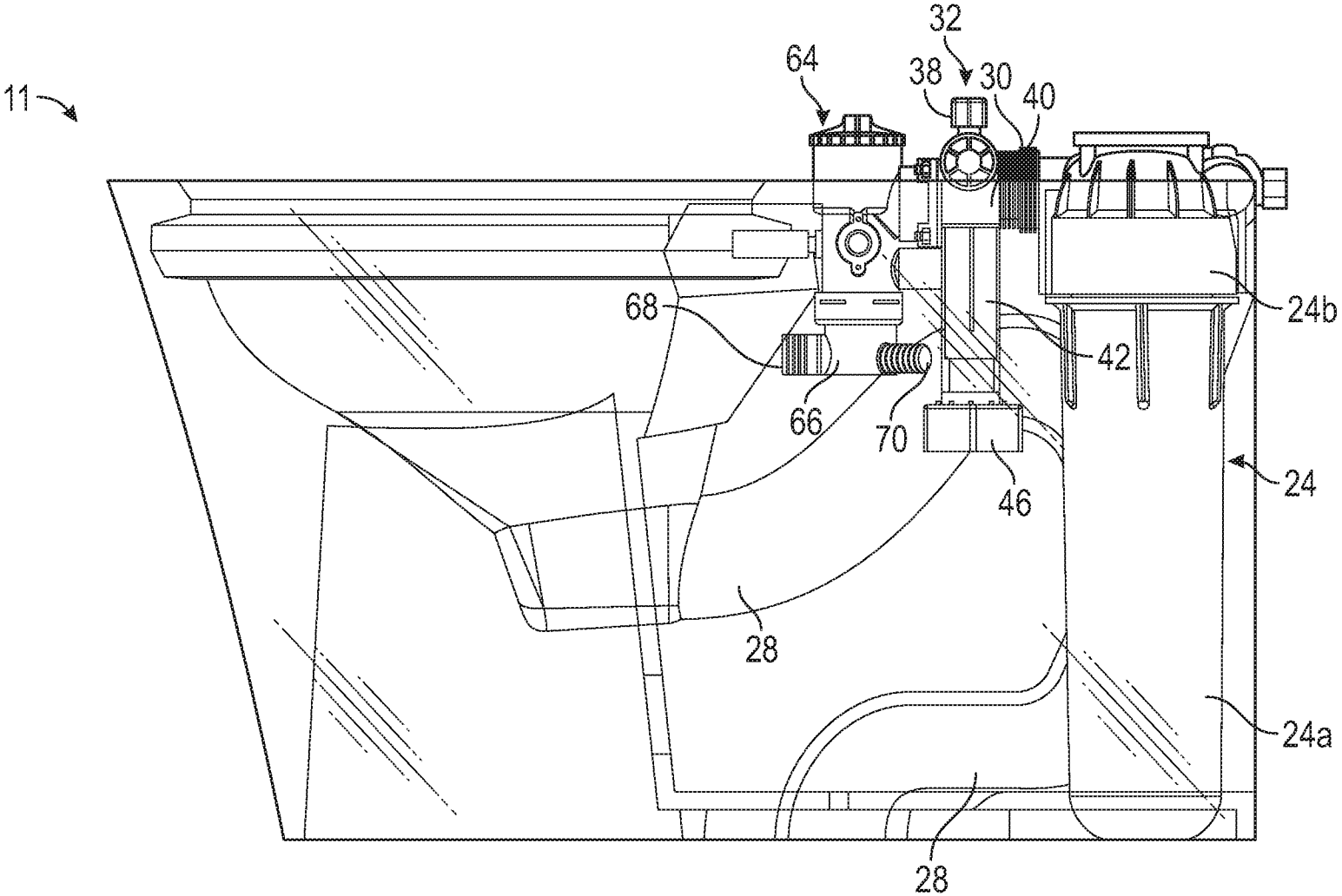
FIG. 4 shows a "see-through" side view of the pressurized toilet.

FIG. 4 provides a view of inlet assembly 32. Inlet assembly 32 includes vent 38. Vent 38 is coupled to an outlet of regulator 36. Inlet assembly 32 includes check valve 40. Check valve 40 is coupled to regulator 36 and vent 38. Check valve 40 may be configured to prevent water from flowing upstream from first tank 24 toward the water supply. Inlet assembly 32 includes venturi 42. Inlet assembly 32 includes an aspirator 44 coupled to venturi 42.

Figure 5:
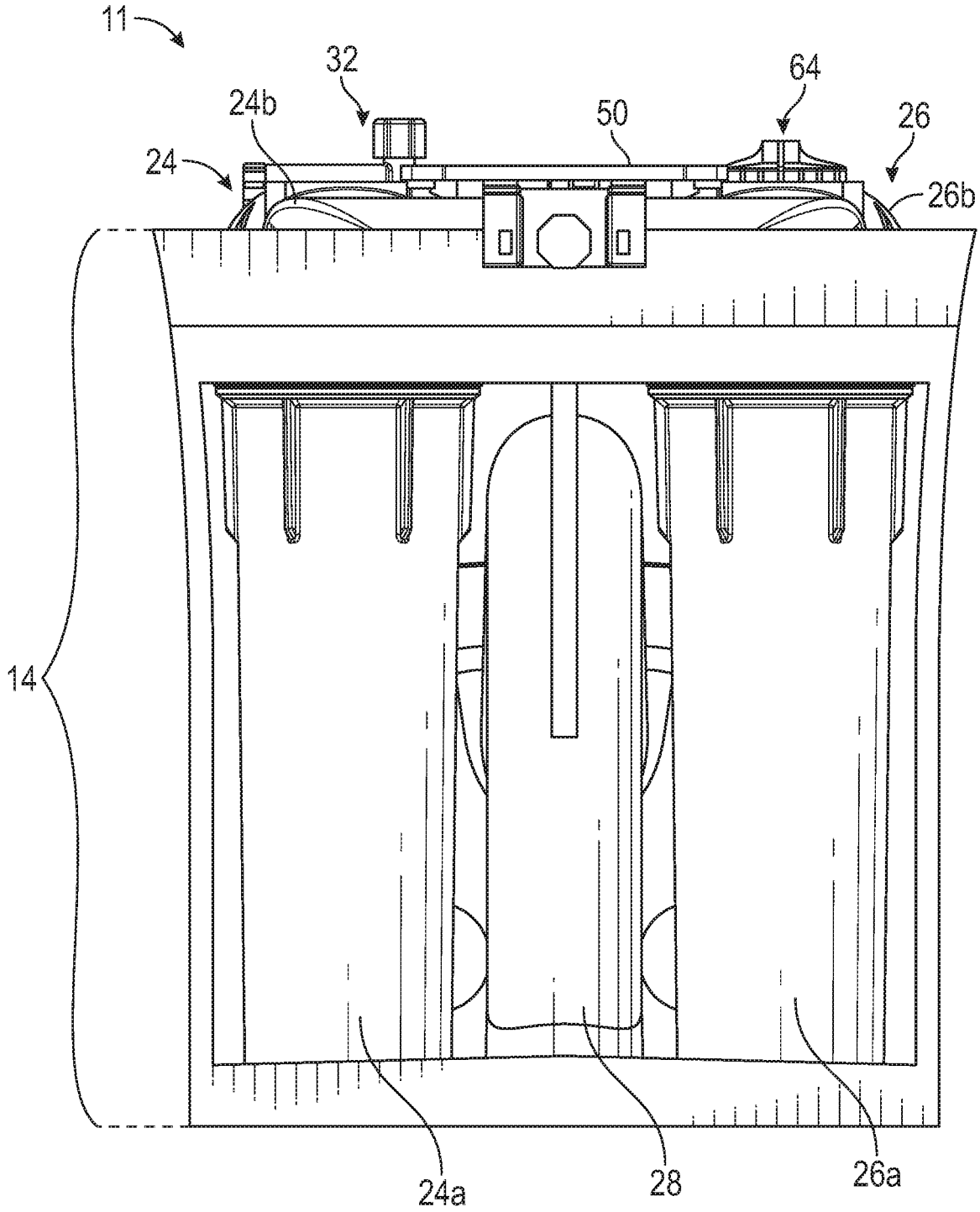
FIG. 5 shows a rear view of the pressurized toilet.

FIG. 5 shows a rear view of toilet assembly 11. First tank 24 and second tank 26 are located within chamber 22 of base 14 of toilet assembly 11. Chamber 22 may include an open rear portion to provide access to pressurized tank assembly 12. Although not depicted, a cover or lid (e.g. a tank lid) may be placed on toilet assembly 11 such that pressurized tank assembly 12 is not visible. The cover may be removable such that access to pressurized tank assembly 12 is permitted for maintenance and/or repair.

Bridge 50 may couple first tank 24 to second tank 26. Bridge 50 may be a structural connection that secures first tank endcap 24*b* to second tank endcap 26*b*. Bridge 50 may not provide for fluid flow, a fluid flow connection between first siphon tank 24 and second siphon tank 26 may be conduit 48. Bridge 50 may be a substantially flat and structurally rigid to provide a connection between first siphon tank 24 and second siphon tank 26 and may operate as a handle for lifting pressurized tank assembly 12 into and out of chamber 22 of toilet assembly 11.

As shown in FIG. 3, bridge 50 may be elongated with rounded ends. The rounded ends may have a similar shape to the cross-sectional view of endcaps 24*b* and 26*b*. The elongated portion between the rounded ends may operate as a handle and allow for a user to grasp with one or both hands. Thus, bridge 50 may provide a manner in which to remove pressurized tank assembly 12 from toilet assembly 11.

Pressurized tank assembly 12 may be removed to allow for maintenance of the pressurized tank assembly, or of components, connections, or couplings thereof, and/or of toilet assembly 11.

Figure 6:
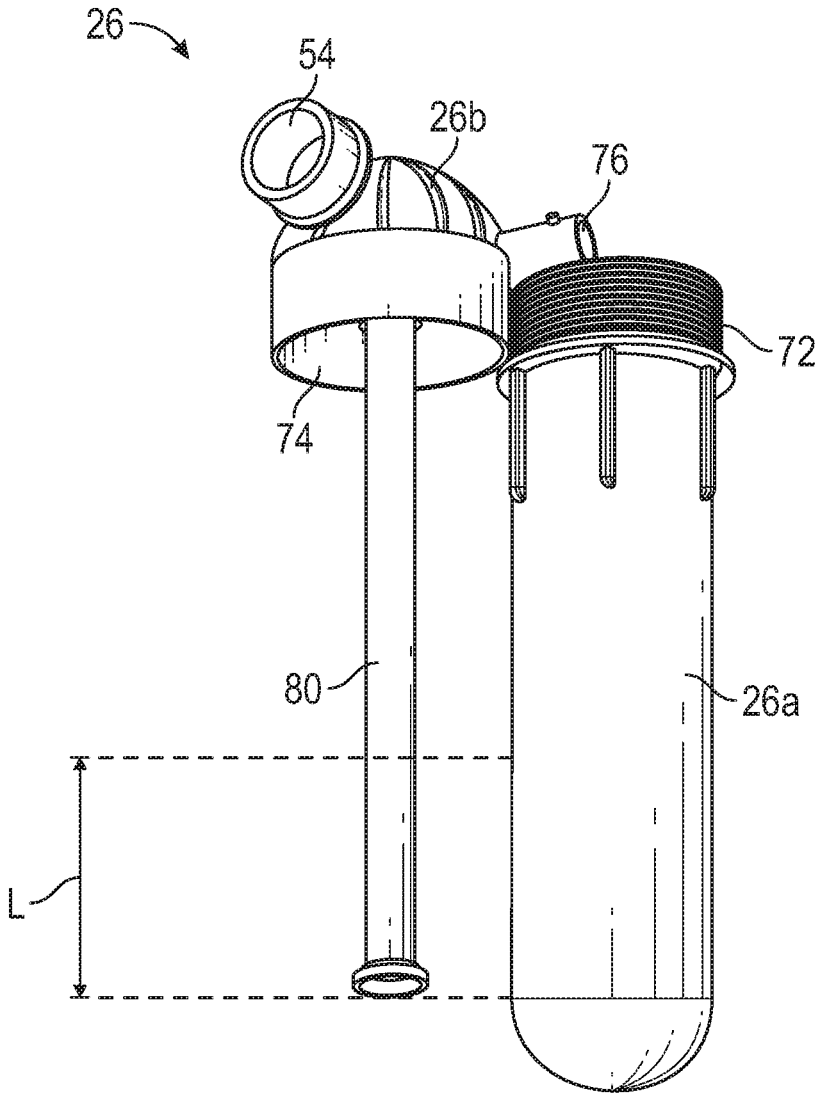
FIG. 6 shows a pressure tank with a siphon tube and endcap disassembled from the pressure tank body for a pressurized toilet, according to an embodiment.
Figure 7:
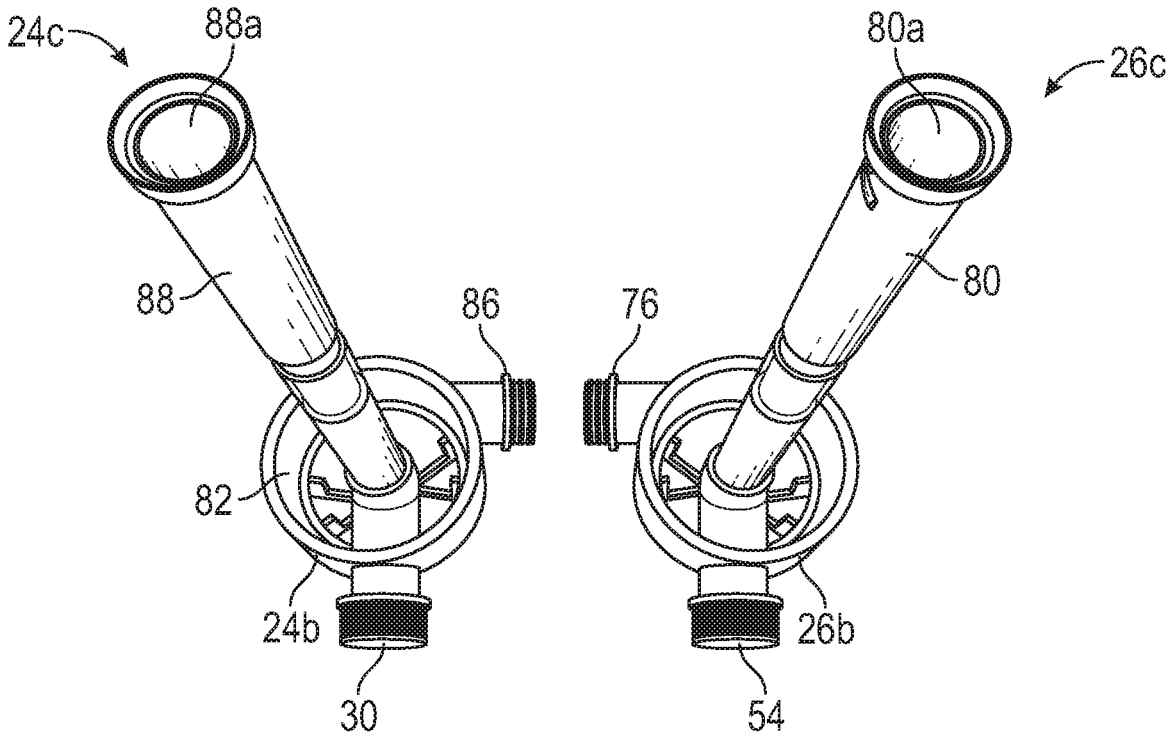
FIG. 7 shows a bottom perspective view of a pair of siphon tubes and endcaps.

FIG. 6 shows second tank 26 in an exploded view to show second tank endcap 26*b* separated from second tank body 26*a*. Second tank body 26*a* may be substantially cylindrical with a rounded lower end and is generally hollow. An upper end of second tank body 26*a* may include threads 72 for coupling to corresponding threads 74 on second tank endcap 26*b*. Although not depicted, first tank 24 may have a first tank body 24*a* that is the same or similar to second tank body 26*a*. Second tank endcap 26*b* may include a second tank inlet 76 and a second tank outlet 54. Second tank inlet 76 may couple to conduit 48 (FIG. 3) for coupling to first tank 24. Second tank inlet 76 may have external threads for coupling to internal threads on conduit 48. Second tank outlet 54 may be coupled to a conduit, such as a tube (not depicted), for coupling to discharge assembly 64 (FIG. 2). Second tank outlet 54 may include internal threads for coupling to external threads on a conduit coupled to discharge assembly 64. Second tank endcap 26*b* may be coupled to a siphon tube 80. Siphon tube 80 may be substantially centered within second tank body 26*a* when second tank 26 is assembled. Siphon tube 80 is configured and assembled to create a suction in accordance with the principles of the invention. Siphon tube 80 may have a length sufficient to create suction and the length, as well as other dimensions of siphon tube 80 may vary depending upon the application and technical requirements of the toilet. As shown, siphon tube 80 may have a length L at the distal end. Length L may represent a distance siphon tube 80 extends into the water volume FIG. 7 shows a first siphon tank subassembly 24*c* and a second siphon tank subassembly 26*c*. First tank subassembly 24*c* may include first tank endcap 24*b* and a siphon tube 88. Second tank subassembly 26*c* may include second tank endcap 26*b* and siphon tube 80. First tank subassembly 24*c* may couple to first tank body 24*a*. Second tank subassembly 26*c* may couple to second tank body 26*a*. First tank subassembly 24*c* and second tank subassembly 26*c* may provide a flow path for fluid as will be described in more detail to follow.

First tank endcap 24*b* may be coupled to siphon tube 88. First tank endcap 24*b* may have threads at area 82 for coupling to corresponding threads on first tank body 24*a* (not shown). First tank endcap 24*b* may include a first tank inlet 30 and a first tank outlet 86. The first tank inlet 30 may be coupled to a conduit, such as a tube (not depicted), for coupling first tank 24 to inlet assembly 32 (FIG. 2). First tank inlet 30 may include internal threads for coupling to external threads on the conduit coupled to the inlet assembly 32. First tank outlet 86 may couple to conduit 48 (FIG. 3) for coupling to second tank 26. First tank outlet 86 may have external threads for coupling to internal threads on conduit 48. Second tank endcap 26*b* may be coupled to a siphon tube 88. Siphon tube 88 may be substantially centered within first tank body 24*a* when the first tank 24 is assembled. The siphon tube 88 may extend an into the water volume, as will be described in more detail to follow.

Alternate embodiments to order of the components of pressurized tank assembly 12 may be contemplated. Additionally, conduits may be added or removed as desired to provide connection between inlet assembly 32, first tank 24, second tank 26, and discharge assembly 64. For example, inlet assembly 32 may be directly connected to first tank inlet 30 of first tank 24. In another example, discharge assembly 64 may be directly connected to second tank outlet 54 of second tank 26. In another example, first tank outlet 86 of first tank 24 may be directly coupled to second tank inlet 76 of second tank 26. Accordingly, threaded connections on inlets and/or outlets may be provided as internal or external threads as necessary to achieve the desired connections. Alternatively, other connection types between parts are contemplated.

Siphon tubes 80 and 88 may be selected and configured to achieve a desired flow and/or desired volume of discharge water within pressurized tank assembly 12. In one aspect, a length of the siphon tubes 80 and/or 88 may be altered. The length of siphon tubes 80 and/or 88 may be selected to achieve the desired flow and/or desired volume of discharge water within pressurized tank assembly 12. Where the length of one or both of the siphon tubes 80, 88 is short (e.g. extending a short distance from respective endcaps 26*b*, 24*b*), the volume for flushing may be greater than where the length of the siphon tubes 80, 88 is long (e.g. extending a longer distance from the respective endcaps 26*b*, 24*b*), since more volume of the respective tank bodies 26*a*, 24*a*, is available for fluid. Additionally, where the length of one or both of the siphon tubes 80, 88 is short (e.g. extending a short distance from the respective endcaps 26*b*, 24*b*), the rate of fluid for flushing may be slower than where the length of the siphon tubes 80, 88 is long (e.g. extending a longer distance from the respective endcaps 26*b*, 24*b*), since there is less length of the siphon tube to achieve a siphon effect. Thus, the length of one or both siphon tubes 80, 88 may be selected to achieve the desired combination of flow rate and volume. Accordingly, the length of siphon tubes 80, 88 may not be equal and one tube may be longer or shorter than the other tube to achieve the desired volume and flow rate.

Thus, siphon tubes 80, 88 may be reduced in length or extended in length to adjust a volume and/or flow rate of fluid within pressurized tank assembly 12. The length of siphon tubes 80, 88 may be selected to achieve a desired discharge volume of water into bowl 18 (FIG. 1) of toilet assembly 11. That is, a desired flush volume for evacuating the toilet bowl. In an alternative embodiment, siphon tube 88 may be omitted or may be shortened to a length such that the siphon tube 88 is effectively omitted. Siphon tubes 80, 88 may prevent or prohibit the pressurized tank assembly from blowing air (i.e., the air equivalent of noise). Maintaining a siphon tube 80, 88 of some discrete length may prevent or prohibit air from entering the pressurized tank assembly downstream.

Siphon tube 80 contains an opening 80*a* at a lower end, that is, an end farthest from second tank endcap 26*b*. Siphon tube 88 contains an opening 88*a* at a lower end, that is, an end farthest from first tank endcap 24*b*. Openings 80*a*, 88*a* may admit or discharge water as necessary for fluid flow through pressurized tank assembly 12, as will be described in more detail to follow. As discussed, the length of siphon tubes 80, 88 may be adjusted. Adjusting the length of siphon tubes 80, 88 adjusts the position of openings 80*a*, 88*a*, within tank bodies 26*a*, 24*a*, respectively. Accordingly, when openings 80*a*, 88*a* extend a short distance in the tank bodies, there is more volume available for flushing liquid (e.g. siphon tubes 80, 88 take up less space within the tank bodies). Additionally, when openings 80*a*, 88*a*, extend a long distance in the tank bodies, there is a longer siphon tube length, allowing for greater velocity of the flushing liquid. Thus, the length of siphon tubes 80, 88 determines the position of openings 80*a*, 88*a*. Although a length of siphon tubes 80, 88 is described as being altered, other dimensions may be altered, such as, for example, the diameter. Additionally, shape of siphon tubes 80, 88 and/or orientation of siphon tubes 80, 88 within the tank bodies may be altered. That is, although siphon tubes 80, 88 are depicted as having circular cross-sections and as being concentrically located in a center of the tank bodies, they may have other cross-sectional shapes and/or be located eccentrically within the tank bodies.

Figure 8:
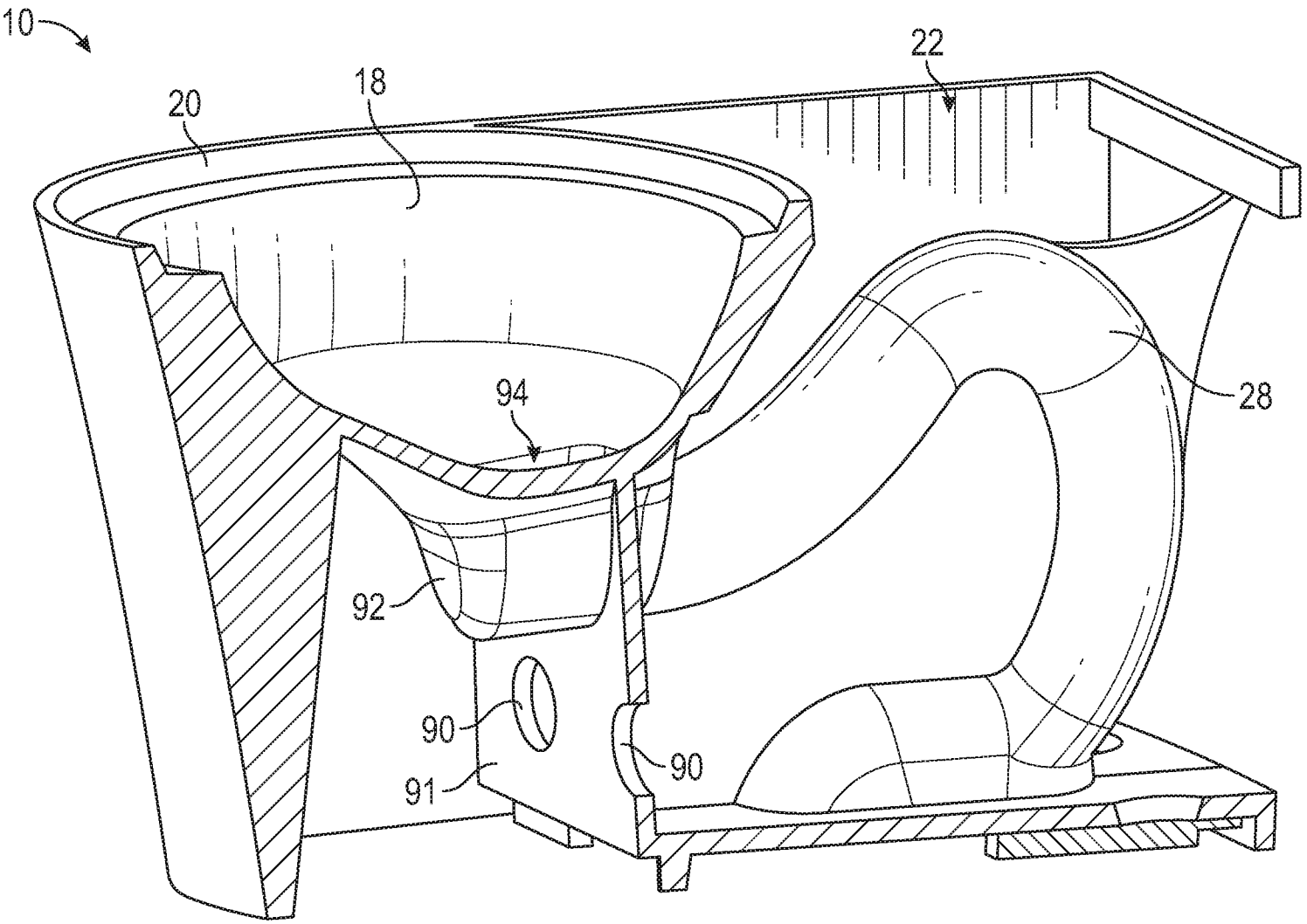
FIG. 8 shows a perspective cross-section of a base for a pressurized toilet, configured to receive a pressurized tank assembly, according to an embodiment.

FIG. 8 shows base 14 of toilet 10 configured to receive pressurized tank assembly 12 (not shown). One or more jet access holes 90 may be provided in a transverse wall 91 of base 14. Jet access holes 90 may allow for a jet channel pipe (not depicted) to be coupled between a jet discharge port 68 (FIG. 4) to a jet outlet 92 in bowl 18. The jet channel pipe may allow for flushing water to be delivered from pressurized tank assembly 12 (FIG. 2) to a sump area 94 of bowl 18. Base 14 may include trapway 28 located in chamber 22. Trapway 28 may be ceramic. Chamber 22 is configured to receive pressurized tank assembly 12.

Figure 9:
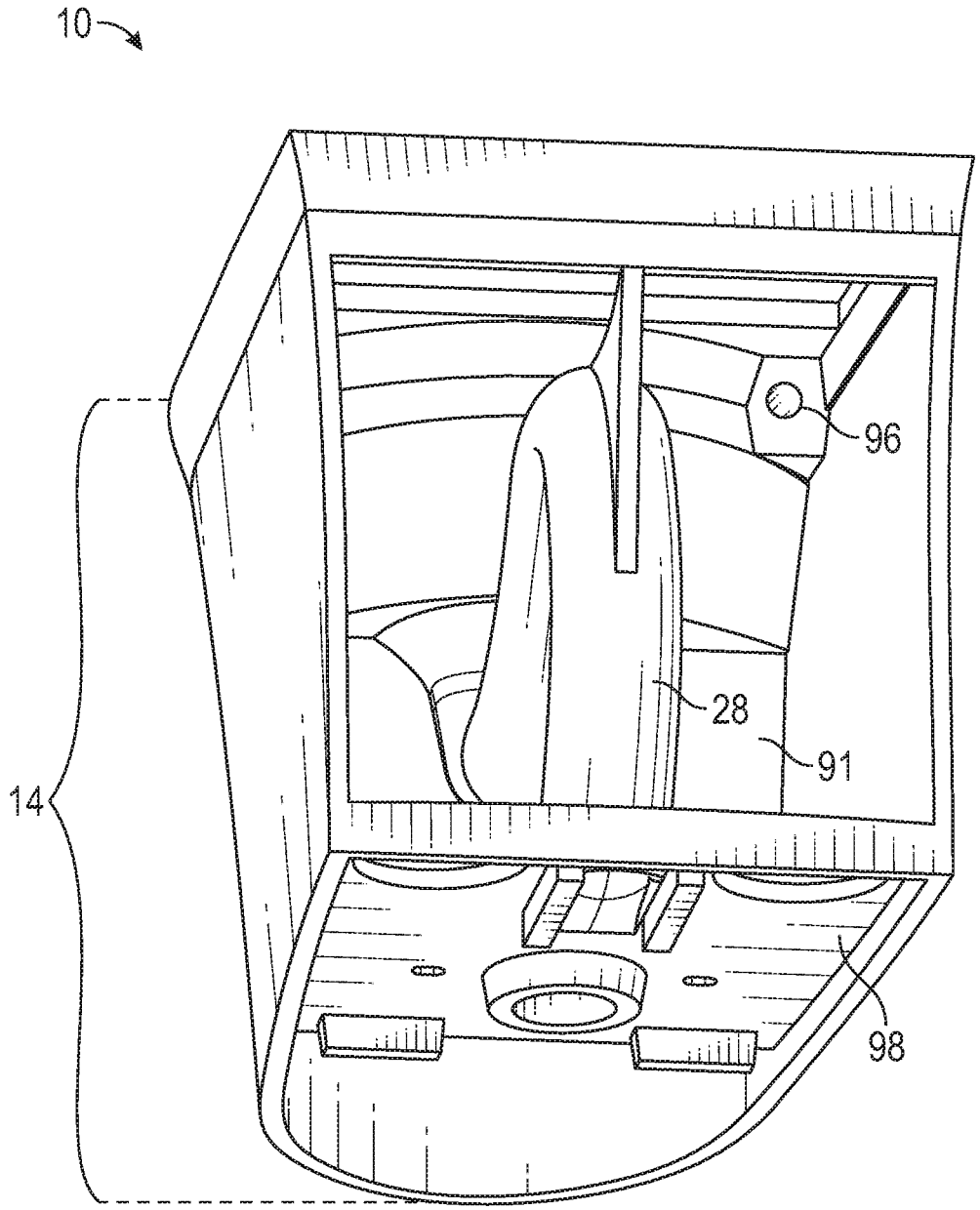
FIG. 9 shows a rear perspective view of the base.

FIG. 9 shows base 14 of toilet 10 configured to receive pressurized tank assembly 12 from a rear view. Base 14 includes bowl 18 having a rim channel 20. Base 14 includes a rim access hole 96. Rim access hole 96 may allow for a rim hose (not depicted) to be coupled between rim discharge port 70 (FIG. 4) to rim channel 20 in bowl 18. The rim hose may allow for flushing water to be delivered from pressurized tank assembly 12 (FIG. 2) to rim channel 20 of bowl 18.

Figure 10:
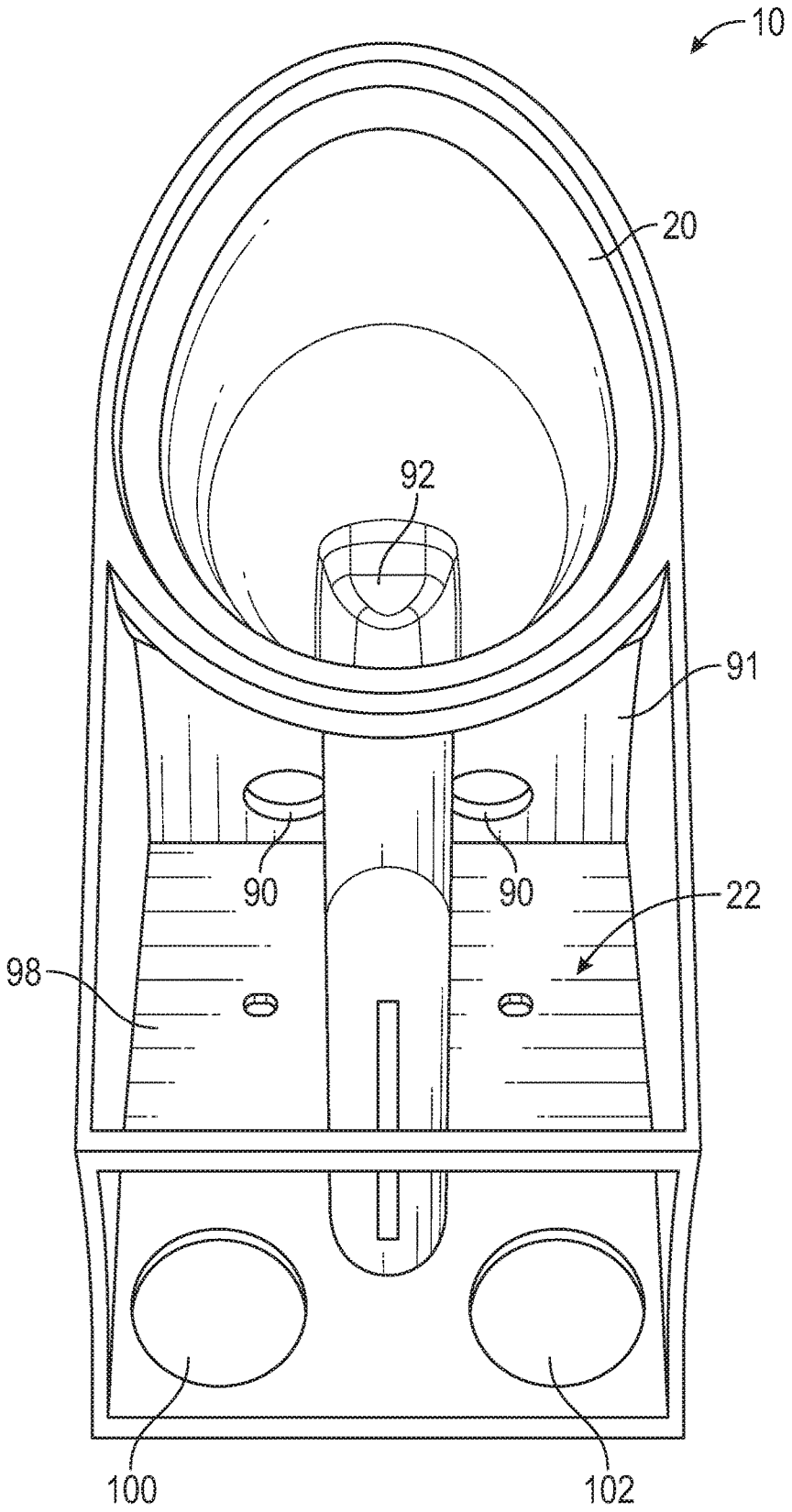
FIG. 10 shows a top perspective view of the base.

FIG. 10 provides a top view of base 14 configured to receive pressurized tank assembly 12. Base 14 includes bottom wall 98. Bottom wall 98 is located within the sidewalls of base 14. Bottom wall 98 may include a first tank recess hole 100 and a second tank recess hole 102. First tank recess hole 100 may receive a bottom portion of first tank 24 (FIG. 2). Second tank recess hole 102 may receive a bottom portion of second tank 26 (FIG. 2). First tank recess hole 100 and second tank recess hole 102 may allow for pressurized tank assembly 12 to be securely received within chamber 22 of toilet assembly 11.

Figure 11:
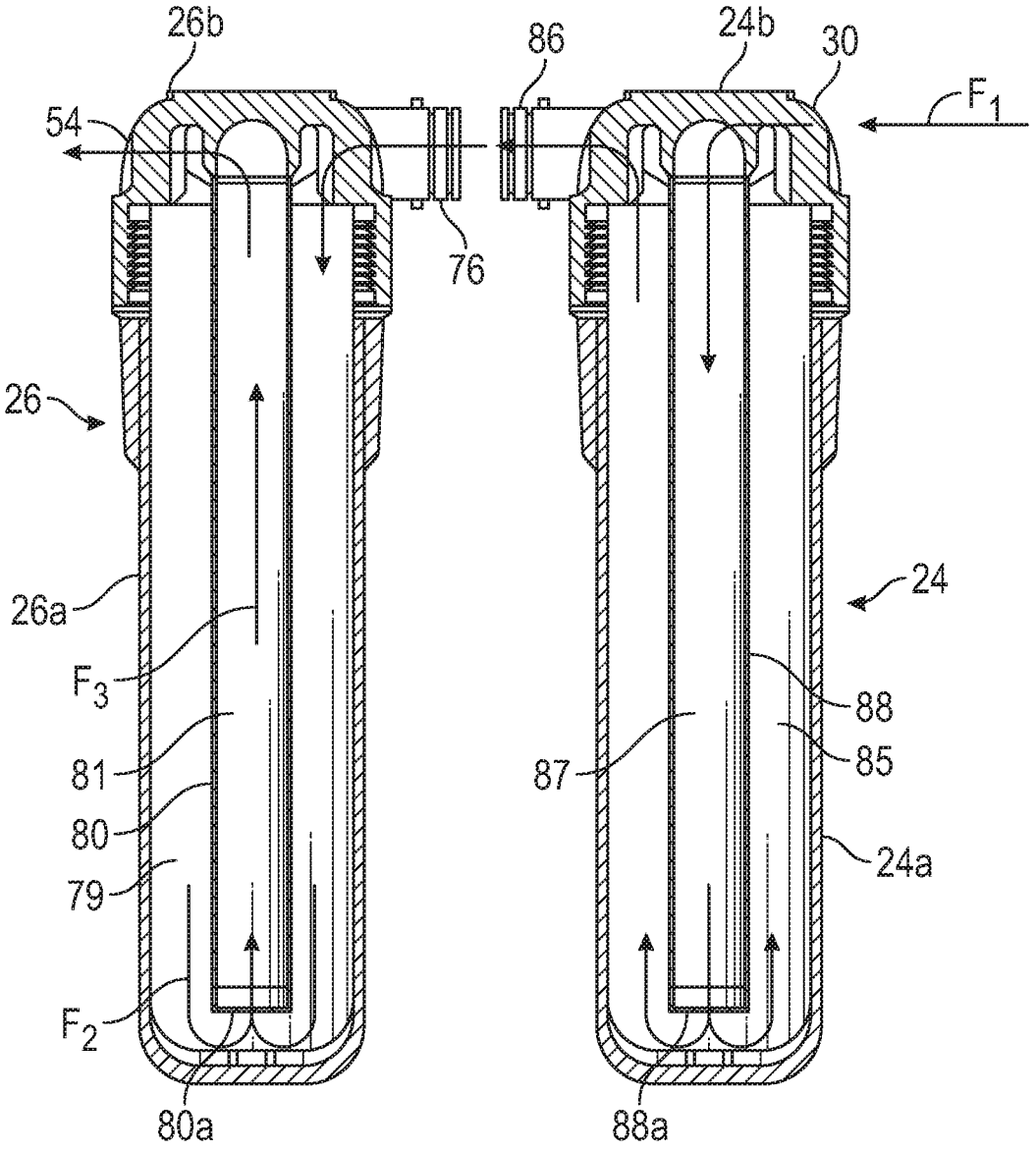
FIG. 11 shows a cross-section view of a pair of tanks with an exemplary flow path for a pressurized toilet, according to an embodiment.

FIG. 11 shows flow of fluid through pressurized tank assembly 12. Pressurized tank assembly 12 may admit a fluid flow $F_1$ from inlet assembly 32 (FIG. 2) through first tank inlet 30. Fluid flow $F_1$ may comprise an air/water mix. For instance, fluid flow $F_1$ may be a mixture of about 65% water and about 35% air. Fluid flow $F_1$ may comprise a mixture having water in the range of about 55% to about 75% and having air in the range of about 25% to about 45%, by volume. Fluid flow $F_1$ may flow through first tank inlet 30 of first tank 24 and into an upper end of a first bore 87 of siphon tube 88. Fluid flow $F_1$ may enter a top of siphon tube 88 and flow downward through first bore 87. Fluid flow $F_1$ may flow through first bore 87 and exit at opening 88*a* near at a lower end of siphon tube 88 into a first space 85. First space 85 may be between an outer surface of siphon tube 88 and an inner wall of first tank body 24*a* of first tank 24. First space 85 may be an annular space. That is, a space between a concentrically positioned siphon tube 88 and first tank body 24*a* forms an annular space around siphon tube 88. Fluid flow $F_1$ exiting opening 88*a* at an end of siphon tube 88 may flow into first space 85. $F_1$ begins as a mixture of water and air. As $F_1$ enters first space 85, flow $F_1$ separates. Water flows towards the bottom of first space 85 and air towards the top of first space 85. Fluid flow $F_1$ flows in an upward direction through first space 85 surrounding the outside of siphon tube 88 and flows upward through first tank body 24*a* and, then, through first tank outlet 86 of first tank 24. From first tank outlet 86 fluid flow $F_1$ may flow through conduit 48 (FIG. 3).

Fluid flow $F_1$ may flow from conduit 48 (FIG. 3) to second tank inlet 76 of second tank 26. As fluid flow $F_1$ enters second tank inlet 76, the flow may be more water than air. Fluid flow $F_1$ may flow through second tank inlet 76 and into an upper end of a second space 79 of second tank 26. Second space 79 may be located between an outer surface of siphon tube 80 and an inner wall of second tank body 26*a*. Second space 79 may be an annular space. Fluid flow $F_1$ may convert to fluid flow $F_2$. Fluid flow $F_1$ may convert to fluid flow $F_2$ at a lower end of second tank body 26*a* and/or a lower end of bore 81 of siphon tube 80. As fluid flow $F_2$ flows into opening 80*a* at a lower end of bore 81 and/or upward through bore 81, $F_2$ may convert to fluid flow $F_3$. Fluid flow $F_3$ may comprise substantially all water in the beginning of a flush cycle. That is, as water settles towards the bottom of second tank body 26*a* due to gravity, opening 80*a* is located in a volume that is substantially all water. Thus, when water is admitted into siphon tube 80, the flow may be substantially all water. When air from the volume above the water volume begins to enter siphon tube 80, fluid flow $F_3$ may transition from substantially all water to a flow having more air or an air/water mixture. As more air enters fluid flow $F_3$, the siphon may terminate and the flush cycle may end. Fluid flow may flow upward through bore 81 through second tank outlet 54 and to discharge assembly 64 (FIG. 2).

As shown in FIG. 11, first siphon tank 24 and second siphon tank 26 may be provided in series. First tank 24 may feed second tank 26. That is, first tank 24 may provide pressurized water to second tank 26 for delivery to toilet assembly 11. Thus, second tank 26 may feed or provide fluid to bowl 18 of toilet assembly 11. First tank 24 and second tank 26 having siphon tubes 80, 88 may provide a siphon assembly. A siphon assembly may create a siphon effect within the pressurized tank assembly 12 to assist in discharge of fluid to a toilet bowl. The serial flow and siphon effect operate to raise pressure of the water from the line pressure of the main water source to the pressure of the water discharged into toilet assembly 11.

In some embodiments, a fully charged tank, first tank 24 and/or second tank 26, may begin at about 25 psi (pounds per square inch) to about 35 psi, for example about 30 psi. When discharge valve assembly 64 is opened to allow discharge of the flush volume, there may be rapid decompression and the pressure may fall to about 0 psi in both first tank 24 and second tank 26. As discharge valve assembly 64 closes, the pressure in the tanks begins to increase from about 0 psi to the range of about 25 psi to about 35 psi, for example about 30 psi. Due to the large flow path at the first tank outlet 86 and the second tank second tank inlet 76, the pressure within first tank 24 and second tank 26 may be substantially or nearly the same or equal under dynamic flow conditions and may be the same or equal under static or no flow conditions.

To charge pressurized tank assembly 12, fluid may be admitted through first tank inlet 30 from inlet assembly 32 (FIG. 2). As water is admitted through the water supply inlet coupling 34, air is pulled in with venturi 42 to provide a water and air mixture (e.g. fluid flow $F_1$). During charging of pressurized tank assembly 12, discharge valve assembly 64 may be closed. As fluid flow $F_1$ enters first space 85 of first tank 24, gravity may cause the water within fluid flow $F_1$ to settle towards the bottom of first tank body 24*a* and air within fluid flow $F_1$ to settle at a level above the water volume. Thus, as shown, there may be a water volume and air volume in the first tank. As fluid flow $F_1$ continues to flow to second tank 26, gravity may again cause water to settle towards the bottom of second tank body 26*a* and air within the flow to settle at a level above the water volume. As discharge valve assembly 64 (FIG. 4) is closed (e.g. the discharge valve reseats), continuous flow of fluid into second tank 26 may compress the air volume on top of the water volume. Thus, when discharge valve assembly 64 is open (e.g. when the toilet is flushed), the compressed air volume may push the water volume up siphon tube 80 (as fluid flow $F_3$) to exit second tank outlet 54. Fluid flow $F_3$ may then move through discharge connection 66 to jet discharge port 68 and rim discharge port 70 (FIG. 4). Discharge valve assembly 64 may remain open a predetermined period of time and/or until a differential pressure falls below a predetermined opening pressure. When discharge valve assembly 64 again closes, the system may recharge pressure tanks 24 and 26 for a subsequent flush cycle. For example, when discharge valve assembly 64 is closed after a flush, inlet assembly 32 may again be opened to admit water and the process previously described may be repeated.

Figure 12:
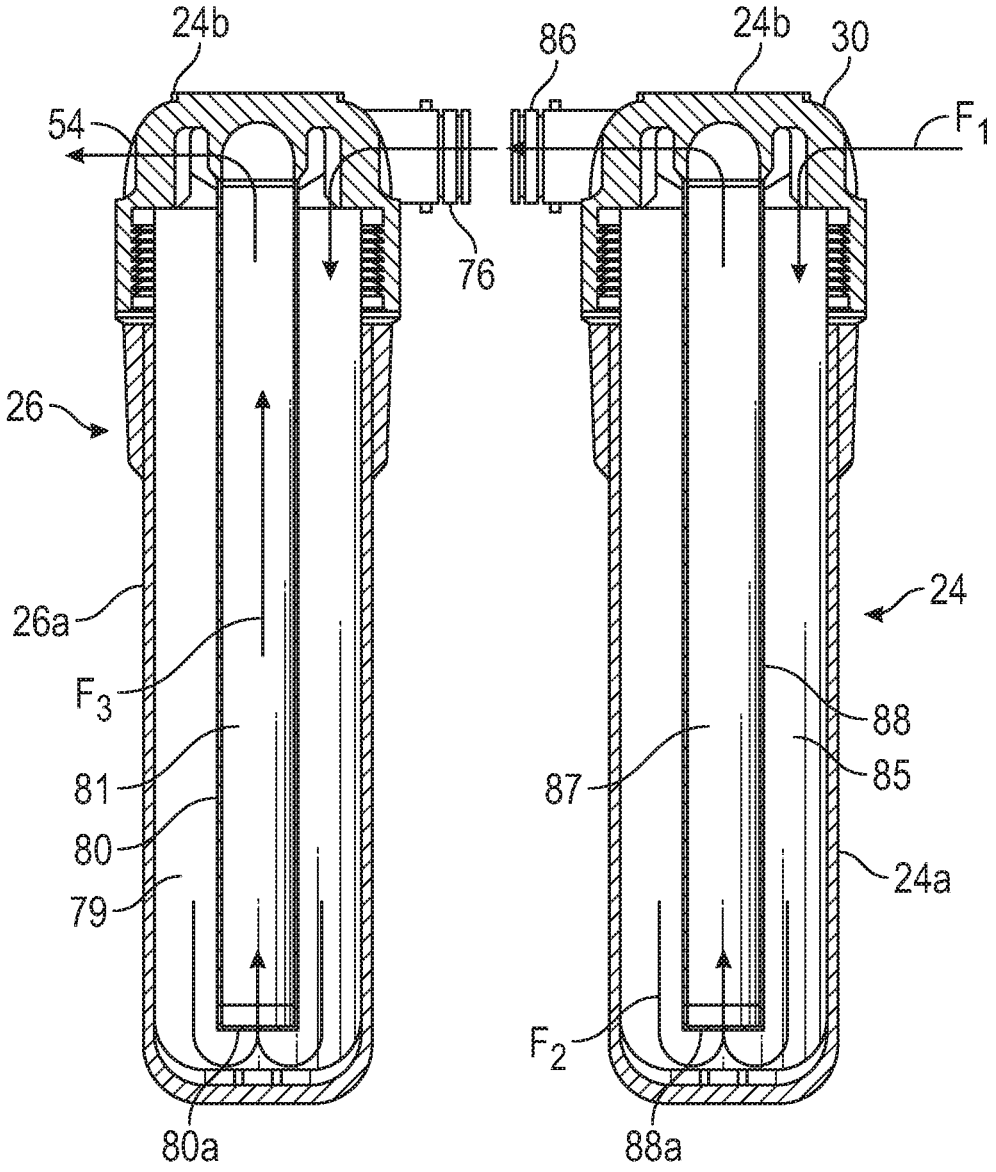
FIG. 12 shows a cross-section view of a pair of tanks with another exemplary flow path for a pressurized toilet, according to an embodiment.

FIG. 12 shows an alternative embodiment of fluid flow. Fluid may flow first to a first space 85. Pressurized tank assembly 12 may admit a fluid flow $F_1$ from inlet assembly 32 (FIG. 2) through first tank inlet 30 of first tank 24. Fluid flow $F_1$ may comprise an air/water mixture. Fluid flow $F_1$ may flow through first tank inlet 30 of first tank 24 and into an upper end of first space 85. Fluid flow $F_1$ may enter a top of first tank body 24*a* and flow downward through first space 85. Fluid flow $F_1$ may convert to fluid flow $F_2$. Fluid flow $F_1$ may convert to fluid flow $F_2$ at a lower end of first tank body 24*a* (e.g. at a lower end of the first space 85) and/or a lower end of first bore 87 of siphon tube 88. Fluid flow $F_1$ may be an air/water mixture. As fluid flow $F_1$ enters first space 85, fluid flow $F_1$ may separate into water towards the bottom of first space 85 and air towards the top of the first space 85. Fluid flow $F_2$ may flow through opening 88*a* and upward through first bore 87 and exit at an upper end of siphon tube 88 into first tank outlet 86 and through conduit 48 (FIG. 3).

Fluid flow $F_2$ may flow from conduit 48 (FIG. 3) to second tank inlet 76 of second tank 26. Fluid flow $F_2$ may flow through second tank inlet 76 and into an upper end of a second space 79 of second tank 26. Second space 79 may be located between the outer surface of siphon tube 80 and an inner wall of second tank body 26*a*. Second space 79 may be an annular space. As fluid flow $F_2$ flows through opening 80*a* and into a lower end of bore 81 and/or upward through bore 81, fluid flow $F_2$ may convert to fluid flow $F_3$. Fluid flow $F_3$ may be substantially all water in the beginning of a flush cycle. That is, as water settles towards the bottom of second tank body 26*a* due to gravity, opening 80*a* is located in a volume that is substantially all water. Thus, when water is admitted into siphon tube 80, the flow may comprise substantially all water. When air from the volume above the water volume begins to enter siphon tube 80, fluid flow $F_3$ may transition from substantially all water to a flow having more air or an air/water mixture. As more air enters fluid flow $F_3$, the siphon may terminate and the flush cycle may end. The fluid flow may flow upward through bore 81 through second tank outlet 54 and to discharge assembly 64 (FIG. 2). Operation of the pressurized tank system may be the same as described with respect to FIG. 11, with the flow into the first tank altered as described.

In some embodiments, the toilet of the disclosure provides a small, lower profile, small foot print toilet. The pressurized tank assembly of the disclosure fits within the base of the toilet to provide a small toilet that is serviceable by the customer and/or a technician. The pressurized tank assembly may simply be pulled out (e.g. via a bridge) to service, repair, replace, and/or maintain the components of the pressurized tank assembly.

In some embodiments, a toilet sidewall may be smooth and/or flat. In some embodiments, a toilet may be a concealed trapway toilet, wherein the trapway is not visible. A toilet may be any toilet, such as a VorMAX® toilet, where the trapway and toilet remain primed before, after, and during a flush. A toilet may comprise a rim channel and jet outlet or, the toilet may be provided without a rim channel. That is, a toilet may have both rim flow and bowl flow for flushing of the toilet or the toilet may have bowl flow only for flushing of the toilet.

In some embodiments, a toilet includes a first tank and a second tank, wherein the first tank is a main tank which supplies fluid to the second tank. A second tank may be a discharge tank which supplies fluid to the toilet. The first tank may be arranged in series with the second tank, wherein flow from the first tank flows directly into the second tank. In some embodiments, a first tank may have a body comprising a substantially cylindrical housing. In some embodiments, a housing may have a rounded lower end that may be substantially hollow. In some embodiments, a first tank may have a first tank endcap. A first tank endcap may comprise a dome shape. A first tank endcap may be secured to a tank body by various methods, for instance via one or more of threads, adhesives, latches, snaps, or other connection types. A first tank endcap may be fluidly coupled to an interior of a first tank body. Likewise, a second tank may comprise a second tank body and a second tank endcap.

In some embodiments, a pressurized tank assembly may be housed entirely within a toilet base chamber such that, when the toilet is assembled, the pressurized tank assembly is not visible. A first tank and a second tank may be arranged on opposing sides of a trapway. A first tank and/or a second tank may be arranged vertically within a toilet base chamber. A first siphon tank and/or a second siphon tank may be arranged such that a fluid inlet and fluid outlet is located at or near the top of the base chamber. A first tank and/or a second tank may be arranged such that an inlet assembly, discharge assembly, and/or any valves or other features are located at or near or towards the top of the toilet. In other embodiments, only one tank may be provided in a pressurized tank assembly. In the case of one tank, the single tank may be sized for the target flush volume.

In some embodiments, a first tank may have a first tank inlet coupled to a fluid inlet assembly. An inlet assembly may include a water supply inlet coupling. A water supply inlet coupling may be coupled to a water supply line, main water source, and/or water supply from a wall of a restroom. In some embodiments, an inlet assembly may include a regulator. A regulator may be coupled to a water supply inlet coupling. A regulator may control the pressure of water flowing into the first tank from the water supply. In some embodiments, a regulator may have a pressure limit of about 30±5 psi. In some embodiments, an inlet assembly may include a vent. A vent may be coupled to an outlet of a regulator. A vent may be configured to vent excess pressure. An inlet assembly may include a check valve. A check valve may be coupled to a regulator and vent. A check valve may prevent water from flowing upstream from the first tank toward the water supply. In some embodiments, an inlet assembly may include a venturi. An inlet assembly may include an aspirator coupled to a venturi. An aspirator may admit air into the water flow from a water supply inlet coupling to provide a mixed flow of water and air to the first tank. An aspirator may be selected to achieve a desired air/water ratio. An aspirator may be sized and/or shaped to allow a predetermined amount of air into an inlet assembly. By selecting an aspirator sized for a particular air flow, an air/water ratio of fluid flowing into the pressurized tank assembly may be optimized to a predetermined value. An inlet assembly may include a coupling configured to couple a conduit, such as a tube, between an inlet assembly and a first tank inlet.

In some embodiments, a second tank may have a second tank body and a second tank endcap. A second tank body may comprise a substantially cylindrical housing. The second tank endcap may comprise a dome shape. A second tank endcap may be secured to a second tank body. A second tank may include a second tank outlet coupled to a discharge assembly. In some embodiments, a discharge assembly may include a riser tube connected with coupling to a second tank outlet. A riser tube may be coupled to a pressure relief valve and a discharge valve assembly. A discharge valve assembly may be downstream of a pressure relief valve. A discharge valve assembly may be coupled to a discharge connection. A discharge valve assembly may be a pressure actuated valve. A discharge connection may have a jet discharge port and a rim discharge port. A jet discharge port may deliver fluid to a jet of the toilet and a rim discharge port may deliver fluid to a rim channel of the toilet.

In some embodiments a first tank may be fluidly coupled to a second tank. A first tank may be fluidly coupled to a second tank with a conduit. In some embodiments, a conduit may be a pipe or tube. A conduit may couple a first tank outlet to a second tank inlet. A conduit may include a drain port. A drain port may be configured to allow for a pressurized tank assembly to be tested prior to use. A first tank may be structurally coupled to a second tank via a bridge. A bridge may be secured to a first tank endcap and a second tank endcap. A bridge may be configured to maintain a first tank and a second tank in proper alignment.

In some embodiments, a first tank and a second tank may be located within a chamber of a toilet. A trapway may be located within a chamber of the toilet. A first tank may be on a first side (e.g. the left side) of the trapway and a second tank may be positioned on a second side (e.g. the right side) of the trapway. The chamber may be sufficiently large to accommodate a pressurized tank assembly, trapway, and other components of a toilet such that essentially no components are visible from an exterior of the toilet.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The term "adjacent" means "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" means for example configured for liquid or gas flow there through and may be synonymous with "fluidly coupled". The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

All U.S. patent applications, published patent applications and patents referred to herein are hereby incorporated by reference.

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

The invention claimed is:

1. A pressure-assist toilet assembly comprising a toilet base comprising a toilet bowl and a chamber; and a pressurized tank assembly positioned in the chamber, wherein the pressurized tank assembly comprises a siphon assembly, the siphon assembly comprises a first siphon tube positioned within a first siphon tank and a second siphon tube positioned within a second siphon tank, and the first siphon tank is fluidly coupled to the second siphon tank.

2. The pressure-assist toilet assembly of claim 1, wherein the first siphon tube is positioned substantially concentrically within a first tank body of the first siphon tank, and the second siphon tube is positioned substantially concentrically within a second tank body of the second siphon tank.

3. The pressure-assist toilet assembly of claim 1, wherein the first siphon tube is coupled to a first tank endcap, the second siphon tube is coupled to a second tank endcap, and wherein the first tank endcap and the second tank endcap face upward in the chamber.

4. The pressure-assist toilet assembly of claim 1, wherein a length of the first siphon tube is determinate of a flush volume to be discharged from the pressurized tank assembly.

5. The pressure-assist toilet assembly of claim 1, wherein the first siphon tank comprises an inlet configured to receive a fluid flow, and wherein the fluid flow comprises an air/water mixture.

6. The pressure-assist toilet assembly of claim 1, wherein the siphon assembly is configured to provide a fluid siphon effect, and wherein the siphon effect encourages a fluid flow to the toilet bowl.

7. The pressure-assist toilet assembly of claim 1, comprising a lid configured to cover the pressurized tank assembly and to be positioned on the toilet base.

8. The pressure-assist toilet assembly of claim 1, wherein the toilet base comprises a first recess configured to receive the first siphon tank, and a second recess configured to receive the second siphon tank.

9. The pressure-assist toilet assembly of claim 1, wherein the first siphon tank and the second siphon tank are arranged vertically within the chamber.

10. The pressure-assist toilet assembly of claim 1, wherein the first siphon tank and the second siphon tank are located on opposing sides of a trapway within the chamber.

11. The pressure-assist toilet assembly of claim 1, wherein the pressurized tank assembly comprises a bridge coupling the first siphon tank to the second siphon tank, the bridge configured to facilitate removal of the pressurized tank assembly from the chamber.

12. The pressure-assist toilet assembly of claim 1, wherein the pressurized tank assembly comprises an inlet assembly fluidly coupled to the first siphon tank and a discharge assembly fluidly coupled to the second siphon tank.

13. The pressure-assist toilet assembly of claim 1, wherein the first siphon tank and the second siphon tank are arranged in series.

14. The pressure-assist toilet assembly of claim 2, wherein the pressurized tank assembly is configured to allow fluid to flow through an inlet of the first siphon tank, through the first siphon tube, through a space between the first siphon tube and the first siphon tank body, through a space between the second siphon tube and the second siphon tank body, and through the second siphon tube to exit an outlet of the second siphon tank.

15. The pressure-assist toilet assembly of claim 2, wherein the pressurized tank assembly is configured to allow fluid to flow through an inlet of the first siphon tank, through a space between the first siphon tube and the first siphon tank body, through the first siphon tube, through a space between the second siphon tube and the second siphon tank body, and through the second siphon tube to exit an outlet of the second siphon tank.

16. The pressure-assist toilet assembly of claim 1, wherein the pressurized tank assembly comprises an inlet assembly and a discharge assembly, and wherein the inlet assembly and the discharge assembly are positioned towards an upper surface of the toilet base.

17. The pressure-assist toilet assembly of claim 3, wherein the first tank endcap and the second tank endcap are positioned towards an upper surface of the toilet base.

18. A pressurized tank assembly for a toilet, comprising a siphon assembly comprising a first siphon tank having a first tank body and a first tank endcap;

a second siphon tank having a second tank body and a second tank endcap; and a first siphon tube positioned within the first tank body and a second siphon tube positioned within the second tank body; and an inlet assembly fluidly coupled to the first siphon tank, and a discharge assembly fluidly coupled to the second siphon tank.

19. The pressurized tank assembly of claim 18, wherein the inlet assembly comprises a pressure regulator, a venturi, an aspirator, and a check valve, and wherein the inlet assembly is located upstream of the first siphon tank.

20. The pressurized tank assembly of claim 18, wherein the discharge assembly comprises a discharge valve, a jet discharge port, and a rim discharge port, and wherein the discharge assembly is located downstream of the second siphon tank.

21. The pressurized tank assembly of claim 18, wherein the first siphon tank is fluidly coupled to the second siphon tank.

* * * * *